US011124972B2

(12) United States Patent
Jang

(10) Patent No.: US 11,124,972 B2
(45) Date of Patent: Sep. 21, 2021

(54) CONSTRUCTION MEMBER

(71) Applicant: Hong Seok Jang, Anyang-si (KR)

(72) Inventor: Hong Seok Jang, Anyang-si (KR)

( * ) Notice: Subject to any disclaimer, the term of this patent is extended or adjusted under 35 U.S.C. 154(b) by 0 days.

(21) Appl. No.: 17/049,878

(22) PCT Filed: Jun. 19, 2018

(86) PCT No.: PCT/KR2018/006889
§ 371 (c)(1),
(2) Date: Oct. 22, 2020

(87) PCT Pub. No.: WO2019/235677
PCT Pub. Date: Dec. 12, 2019

(65) Prior Publication Data

US 2021/0087825 A1 Mar. 25, 2021

(30) Foreign Application Priority Data

Jun. 8, 2018 (KR) ..... 10-2018-0066024

(51) Int. Cl.
*E04F 13/08* (2006.01)
*E04F 15/02* (2006.01)

(52) U.S. Cl.
CPC ..... *E04F 13/0885* (2013.01); *E04F 13/0835* (2013.01); *E04F 13/0871* (2013.01);
(Continued)

(58) Field of Classification Search
CPC ..... E04F 13/0885; E04F 13/0871; E04F 13/0835; E04F 13/0894; E04F 2201/042;
(Continued)

(56) References Cited

U.S. PATENT DOCUMENTS 4,700,527 A * 10/1987 Pardo ..... E04B 2/12 52/772
2018/0051471 A1* 2/2018 Goldsmith ..... E04F 13/0733

FOREIGN PATENT DOCUMENTS

KR 20-0364366 10/2004
KR 20-0399609 10/2005
(Continued)

OTHER PUBLICATIONS

International Search Report, with English translation, for International Application No. PCT/KR2018/006889, dated Mar. 5, 2019.
(Continued)

*Primary Examiner* — Patrick J Maestri
(74) *Attorney, Agent, or Firm* — Kile Park Reed & Houtteman PLLC

(57) ABSTRACT

The present invention relates to a construction member, in which members are consecutively mounted in the vertical, horizontal, or both vertical and horizontal directions of the wall of a building, wherein the members are rectangular and have member insertion grooves that are horizontally formed on the rear surface thereof at intervals. A construction member according to the present invention has at least one member insertion groove formed on the rear surface of a member, thereby being easily attached and fixed to the wall or the floor of the building, reducing construction time and construction costs, and enabling an unskilled worker to easily perform an operation.

4 Claims, 17 Drawing Sheets

(52) U.S. Cl.
CPC ..... *E04F 13/0894* (2013.01); *E04F 15/0215* (2013.01); *E04F 15/02038* (2013.01); *E04F 2201/0138* (2013.01); *E04F 2201/023* (2013.01); *E04F 2201/042* (2013.01)

(58) Field of Classification Search
CPC ..... E04F 2201/023; E04F 15/0215; E04F 13/0803; E04F 13/0816; E04F 13/0819
See application file for complete search history.

(56) References Cited

FOREIGN PATENT DOCUMENTS

| | | |
|---|---|---|
| KR | 20-0439812 | 5/2008 |
| KR | 10-0901079 | 6/2009 |
| KR | 20-2011-0005459 | 6/2011 |
| KR | 10-1617785 | 5/2016 |
| KR | 10-2016-0149375 | 12/2016 |

OTHER PUBLICATIONS

Written Opinion, with English translation, for International Application No. PCT/KR2018/006889, dated Mar. 5, 2019.

* cited by examiner

CONSTRUCTION MEMBER

TECHNICAL FIELD

The present invention relates to a construction member, and more particularly to a construction member, which is used as an interior/exterior material attached to walls or roofs of buildings or as a flooring material attached to floors of buildings.

BACKGROUND ART

Various kinds of exterior materials, which are currently being used for buildings, require respective different skilled technicians on construction sites.

For example, the construction of bricks requires masonry workers, the construction of tiles requires tile workers, the construction of marbles requires masons, and the construction of sliced roof tiles requires roof tile workers. Many problems occur during construction according to the conditions at construction sites or the skills of technicians.

For example, in relation to tiles, which are widely used among members for enhancing the aesthetic appearance of buildings, the first problem thereof is frequent occurrence of peeling, and the second problem thereof is the essential requirement to construct joints, which cause serious contamination of buildings.

In addition, bricks are built only through a masonry method, subsidiary materials installed to support the weight of the bricks are costly, construction costs thereof is high, complicated load calculations are required, working efficiency is low because there is a limitation on how much construction can be carried out in a day due to the load applied by the bricks, and only specialized builders can perform the construction tasks.

In addition, construction using stone essentially requires construction of silicon joints in order to prevent permeation of water due to the inherent characteristics thereof, and considerable contamination attributable to silicon occurs, like bricks. In order to enhance an aesthetic effect, grooves are formed in the surface of the stone, but this is excessively costly and time-consuming.

Due to the above problems, many disputes occur between building owners and architecture companies, which greatly increase construction costs, consumption of subsidiary materials, and the cost of repairing defects. Because skilled builders are exclusively required for construction work, the construction environment is becoming increasingly difficult.

DISCLOSURE

Technical Problem

Therefore, the present invention has been made in view of the above problems, and it is an object of the present invention to provide a construction member that includes members, each of which has at least one member insertion groove formed in the rear surface thereof so as to be easily attached to and fixed to walls, roofs and floors of buildings.

In addition, it is an object of the present invention to provide a construction member that includes members, in each of which formation of grooves is naturally induced through a member engagement portion formed at the upper and lower portions thereof, thereby reducing the cost of forming separate grooves.

In addition, it is an object of the present invention to provide a construction member that includes members, which are capable of being continuously installed on walls or floors of buildings in the longitudinal direction thereof.

Technical Solution

A construction member according to an embodiment of the present invention includes members configured to be continuously installed on a wall of a building in an upward/downward direction, in a leftward/rightward direction, or in all directions. Each of the members is formed in a rectangular shape, and includes member insertion grooves formed in the rear surface thereof in the longitudinal direction thereof so as to be spaced apart from each other in a vertical, horizontal, or oblique direction.

Each of the member insertion grooves may include an inlet communicating with the outside and a member insertion space extending inwards from the inlet and accommodating an adhesive material therein, and the member insertion space may be formed to be larger than the inlet.

Here, a support protrusion may be formed in the member insertion space constituting each of the member insertion grooves so as to extend in the longitudinal direction of the member insertion space or to extend intermittently.

In addition, each of the members may include a member engagement portion formed at the upper end portion and the lower end portion thereof in the longitudinal direction thereof, and the member engagement portion may include an engagement protrusion, formed at the upper portion of each of the members in the longitudinal direction of each of the members, and an engagement groove, formed in the lower portion of each of the members in the longitudinal direction of each of the members so as to be engaged with an engagement protrusion of another member.

Alternatively, each of the members may include a member engagement portion formed at the upper end portion and the lower end portion thereof in the longitudinal direction thereof, and the member engagement portion may include a first engagement portion, including a first engagement groove and a first engagement protrusion formed at the upper portion of each of the members in the longitudinal direction of each of the members, and a second engagement portion, including a second engagement protrusion and a second engagement groove formed at the lower portion of each of the members in the longitudinal direction of each of the members so as to be engaged with a first engagement groove and a first engagement protrusion of other members.

Here, an auxiliary engagement portion, including an auxiliary engagement groove and an auxiliary engagement protrusion, may be further formed in the first engagement groove constituting the first engagement portion.

Each of the members may include a rear surface portion including therein the member insertion grooves and an engagement protrusion formed at the upper end portion thereof in the longitudinal direction thereof, and a front surface portion integrally formed with the front portion of the rear surface portion and including a front surface extending vertically and an engagement groove formed in the lower portion thereof so as to allow an engagement protrusion of another member to be inserted thereinto.

In addition, binding members may be selectively mounted so as to be spaced apart from each other in each of the member insertion grooves in a respective one of the members in order to increase strength of bonding to a wall of a building or to an adhesive material.

Here, each of the binding members may include a body having a sharp shape, a head portion formed at an end of the body and slidably inserted into and supported by a corresponding one of the member insertion grooves, and a washer fitted on the body and disposed outside the inlet.

Alternatively, each of the binding members may be configured as one of a lattice-shaped wire net, a lattice-shaped fiber net, and a lattice-shaped glass net, and may include an insertion portion configured to be inserted into a corresponding one of the member insertion grooves. The insertion portion may be formed to be straight or curved.

In addition, ornament members may be selectively mounted on the front portions of the members in order to improve an aesthetic appearance.

In addition, fixing support members may be mounted in the member insertion grooves, and each of the fixing support members may include one side configured to be fixed to an external adhesive material and an opposite side configured to support the upper portion of a corresponding one of the member insertion grooves.

Advantageous Effects

According to a construction member of the present invention, at least one member insertion groove is formed in the rear surface of each of members, thereby making it possible to easily bond and fix the members to walls or floors of buildings, reducing a construction period and costs, and enabling an unskilled worker to easily perform construction tasks.

In addition, according to a construction member of the present invention, the formation of grooves is naturally induced through a member engagement portion formed at the upper and lower portions of each member, thereby reducing the cost of forming separate grooves, and eliminating the process of constructing silicon and joints due to the characteristics of the product, thus reducing costs and the occurrence of contamination and improving the aesthetic appearance of buildings.

In addition, according to a construction member of the present invention, members are capable of being continuously installed on walls, roofs or floors of buildings in the longitudinal direction thereof and of increasing bonding force therebetween.

BEST MODE

Advantages and features of the present invention and methods for achieving them will be made clear from the embodiments described below in detail with reference to the accompanying drawings. The present invention may, however, be embodied in many different forms, and should not be construed as being limited to the embodiments set forth herein. Rather, these embodiments are provided so that this disclosure will be thorough and complete and will fully convey the scope of the invention to those skilled in the art. The present invention is defined only by the scope of the claims. Also, terms used in the following description are used only to describe the embodiments, and are not intended to restrict the present invention. In the specification, an expression in the singular form includes the plural meaning, unless the singular expression is explicitly different in context. It will be further understood that the term "comprises" or "comprising," when used in this specification, specifies the presence of stated components, steps, operations, and/or devices, but does not preclude the presence or addition of other components, steps, operations, and/or devices.

Figure 1:
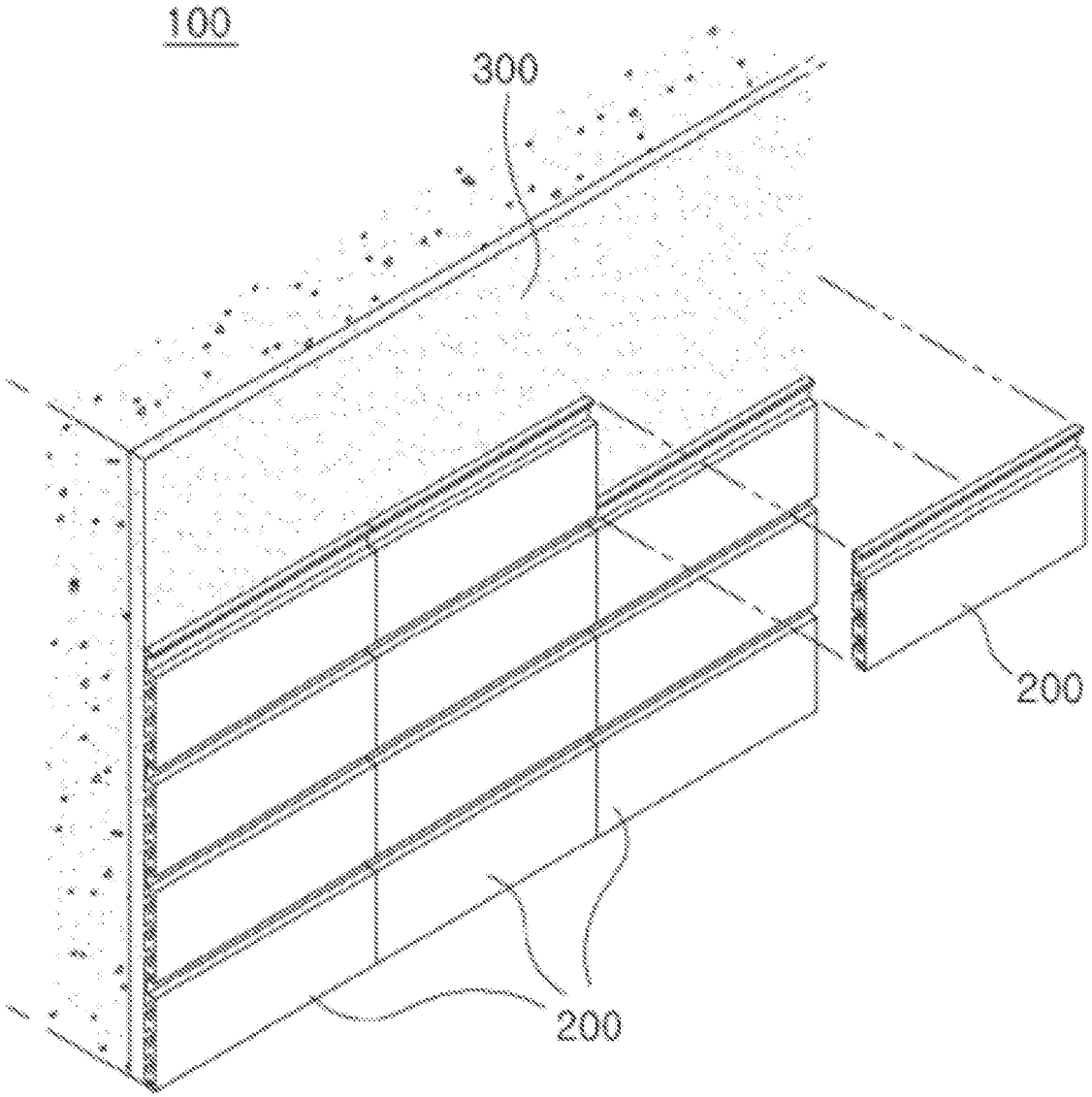
FIG. 1 is a perspective view showing an embodiment of a construction member according to the present invention.
Figure 2:
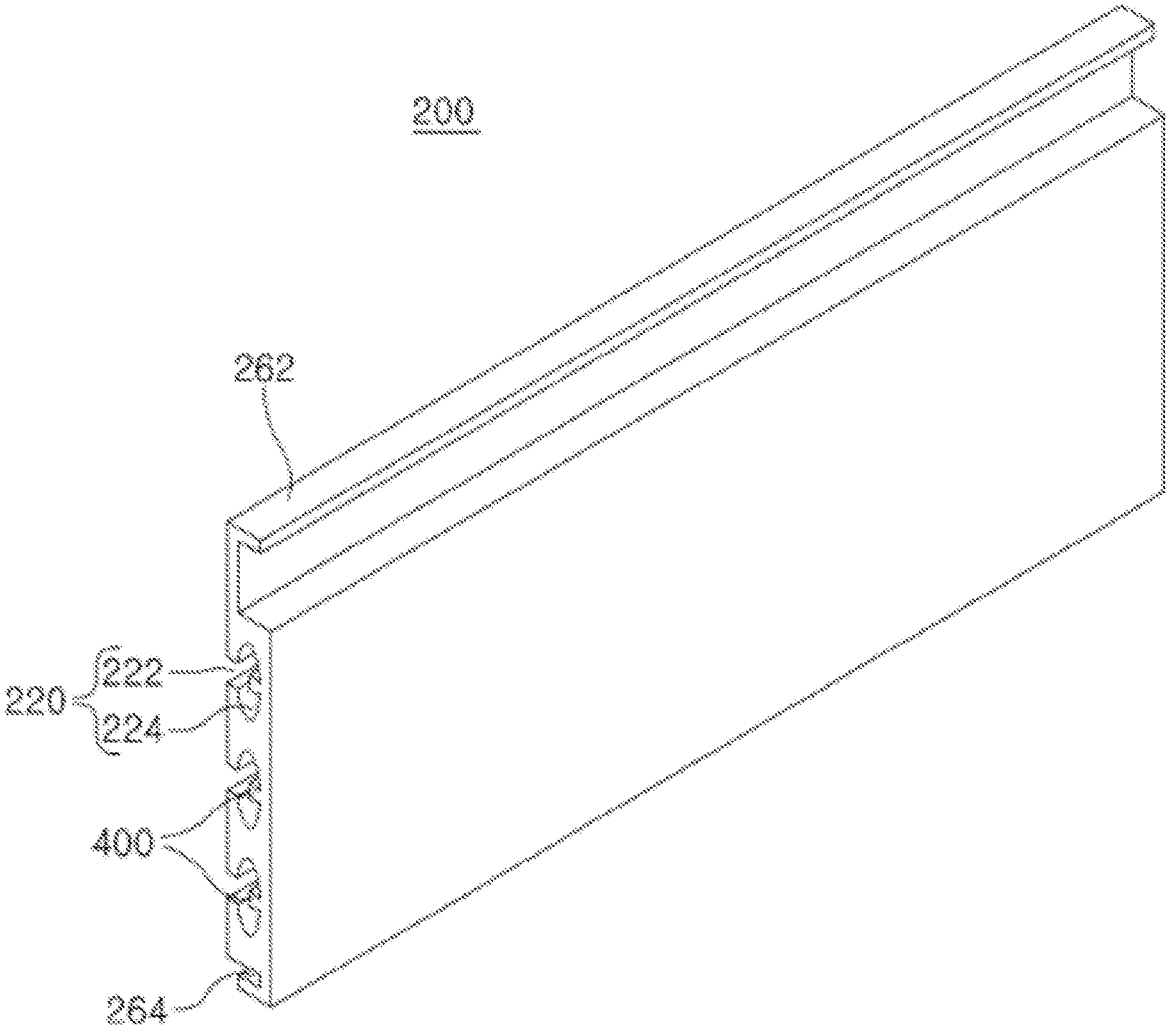
FIGS. 2 and 3 are a perspective view and a rear perspective view showing the components constituting the construction member according to the present invention shown in FIG. 1.
Figure 3:
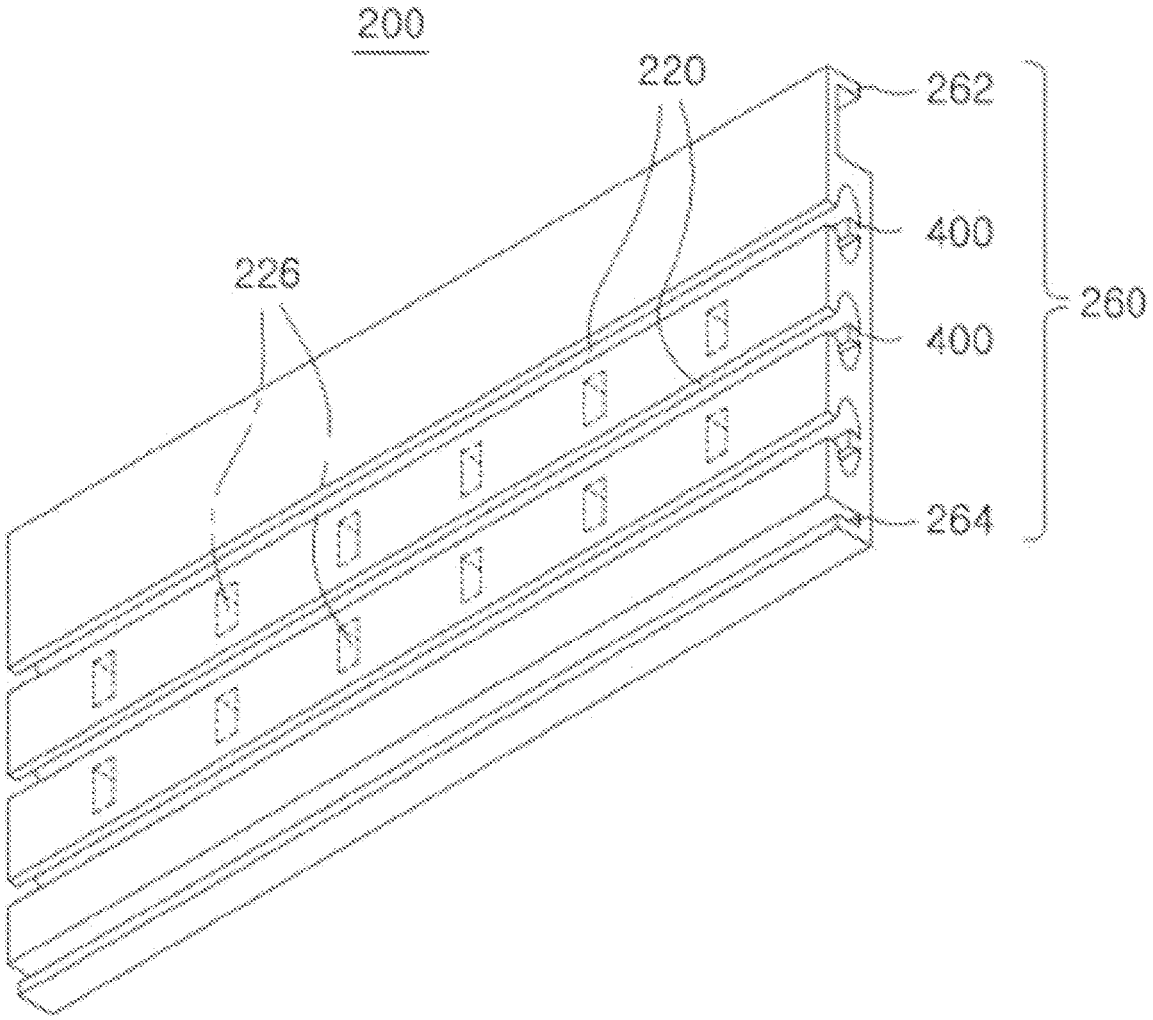

Hereinafter, exemplary embodiments of the present invention will be described in detail with reference to the accompanying drawings. FIG. 1 is a perspective view showing an embodiment of a construction member according to the present invention, and FIGS. 2 and 3 are a perspective view and a rear perspective view showing the components constituting the construction member according to the present invention shown in FIG. 1.

A construction member 100 according to the present invention is used as an interior/exterior material attached to walls or roofs of buildings or as a flooring material attached to floors of buildings.

Hereinafter, the construction member 100 will be described by way of example as including members 200 capable of being continuously installed on walls of buildings in the upward/downward direction, in the leftward/rightward direction, or in all directions.

In addition, the construction member 100 according to the present invention is characterized in that member insertion grooves 220 are formed in the rear surface of the member 200 in a vertical, horizontal, or oblique direction so as to be spaced apart from each other in the vertical or horizontal direction depending on the environment, thereby facilitating insertion of an adhesive material 300, such as cement or mortar, thereinto.

That is, the member 200 is integrally attached to walls of buildings through the adhesive material 300 inserted into the member insertion grooves 220. In this case, the adhesive material 300 is hardened in a hook shape, thereby supporting the member 200.

Hereinafter, the member 200 will be described by way of example as being formed in a rectangular shape. However, the shape of the member 200 may be changed to a circular shape, a polygonal shape, an elliptical shape, etc. depending on the environment, the purpose thereof, or the like.

The member insertion grooves 220 may be formed in the rear surface of the member 200 in the vertical or oblique direction so as to be spaced apart from each other depending on the environment, the purpose thereof, or the like. Instead of the adhesive material 300, binding members, such as fasteners or anchors, may be inserted into the member insertion grooves 220.

That is, the member 200 is advantageously formed to easily accommodate the adhesive material 300 in the member insertion grooves 220 formed in the rear surface thereof such that the adhesive material 300 is evenly disposed at the upper portion and the lower portion of the member 200, thereby minimizing the transfer of eccentric load.

Here, the member insertion groove 220 formed in the rear surface of the member 200 includes an inlet 222, which communicates with the outside, and a member insertion space 224, which extends inwards from the inlet 222 and accommodates the adhesive material 300 therein.

That is, the adhesive material 300 is accommodated in the member insertion space 224 in the member insertion groove 220, and is integrally combined with an adhesive material 300, which is present outside, through the inlet 222, thereby being fixed to walls of buildings.

Further, the member insertion space 224 is formed to be larger than the inlet 222. This is for minimization of spilling of the adhesive material 300 accommodated in the member insertion space 224 to the outside through the inlet 222 and enhancement of bonding to the member 200.

Further, a support protrusion 400 may be formed in the member insertion groove 220 so as to extend in the longitudinal direction of the member insertion groove 220 or to extend intermittently.

That is, the support protrusion 400, which is formed in the member insertion groove 220, serves to increase the strength of bonding to the adhesive material 300 introduced into the member insertion groove 220 and to support the adhesive material 300.

Here, the support protrusion 400 is formed on the middle portion of the rear surface of the member insertion groove 220, and thus uniformly supports the upper portion and the lower portion of the adhesive material 300 accommodated in the member insertion groove 220.

Further, the support protrusion 400 may be increased in number, like the shape of a saw-toothed wheel, or additional support protrusions may be formed as needed.

Furthermore, a plurality of auxiliary bonding grooves 226 or a plurality of auxiliary bonding protrusions may be formed so as to be spaced apart from each other between the member insertion groove 220 and another member insertion groove 220.

That is, bonding to the adhesive material 300 may be enhanced by forming the auxiliary bonding grooves 226 and the auxiliary bonding protrusions between the member insertion groove 220 and another member insertion groove 220.

In this case, in order to increase the strength and the bonding force, the auxiliary bonding grooves 226 and the auxiliary bonding protrusions are formed in a direction different from the direction in which the member insertion grooves 220 are formed (for example, when the member insertion grooves are formed in the horizontal direction, the auxiliary bonding grooves 226 are formed in the vertical direction).

In addition, the member 200 includes a member engagement portion 260 formed at the upper end portion and the lower end portion thereof in the longitudinal direction thereof.

Here, the member engagement portion 260 includes an engagement protrusion 262, formed at the upper portion of the member 200 in the longitudinal direction of the member 200, and an engagement groove 264, formed in the lower portion of the member 200 in the longitudinal direction of the member 200 so as to be engaged with the engagement protrusion of another member.

That is, the engagement protrusion 262 formed at the upper portion of the member 200 and the engagement groove 264 formed in the lower portion of the member 200, which constitute the member engagement portion 260, are engaged with the engagement groove 264 and the engagement protrusion 262 of other members 200 adjacent thereto.

Alternatively, the member engagement portion 260, which constitutes the construction member 100, has the configuration shown in FIGS. 4 to 7, which is different from that shown in FIGS. 1 to 3.

Figure 4:
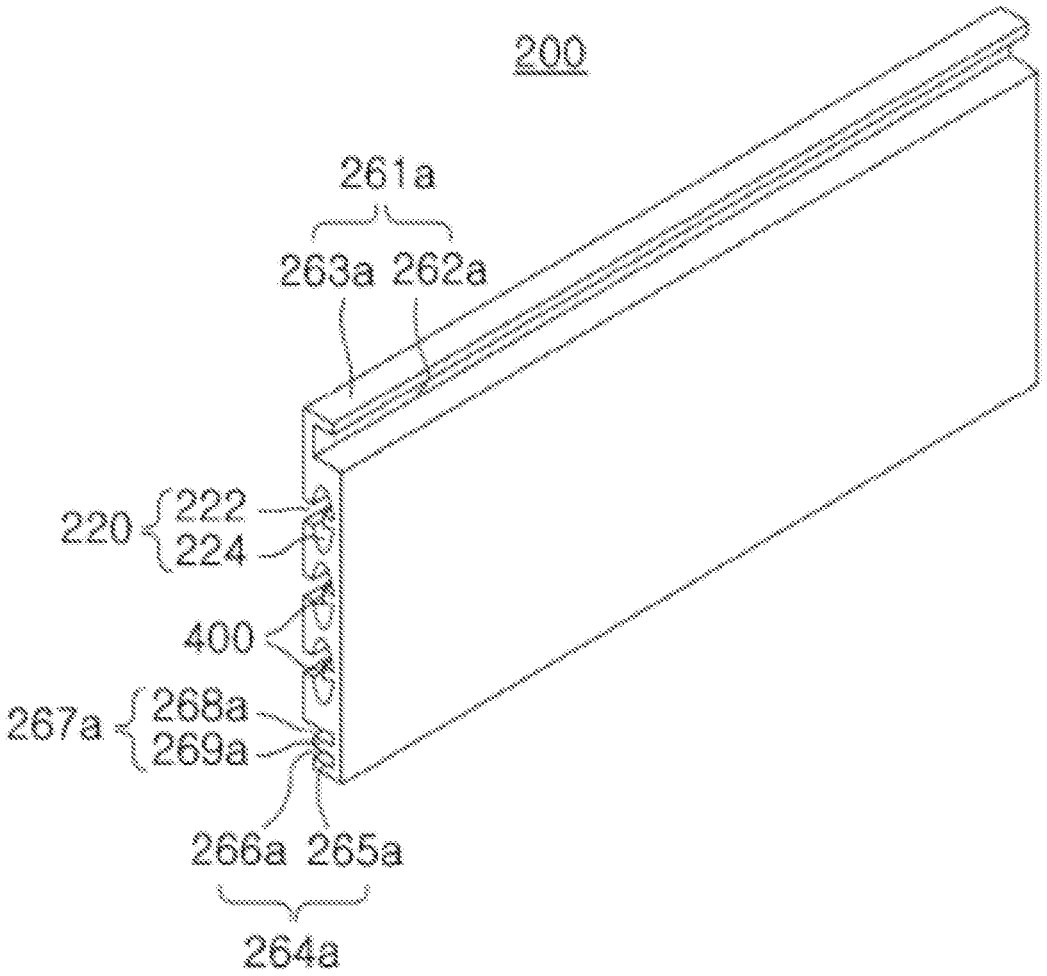
FIGS. 4 and 5 are views showing another embodiment of a member engagement portion positioned at the upper and lower portions of the construction member according to the present invention shown in FIG. 1.
Figure 5:
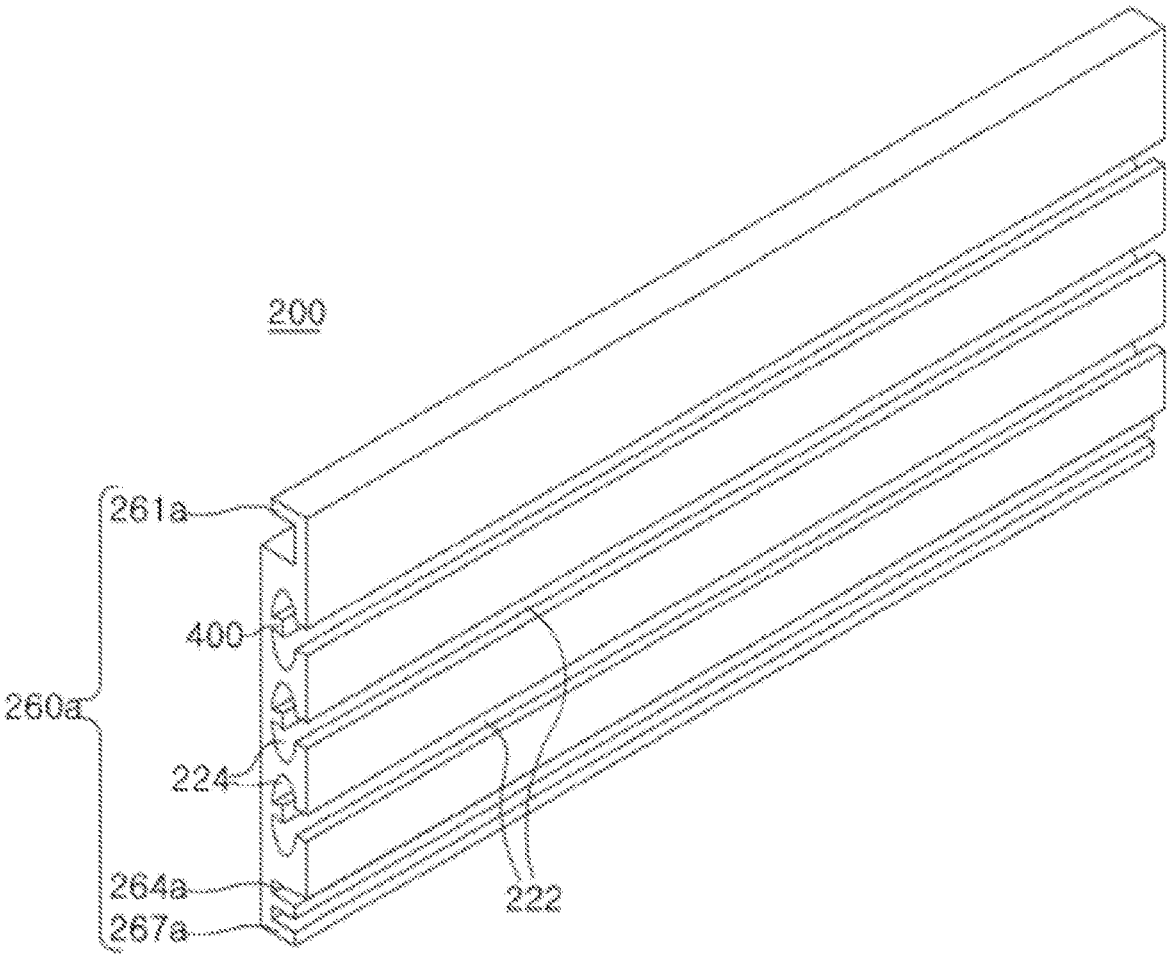
Figure 6:
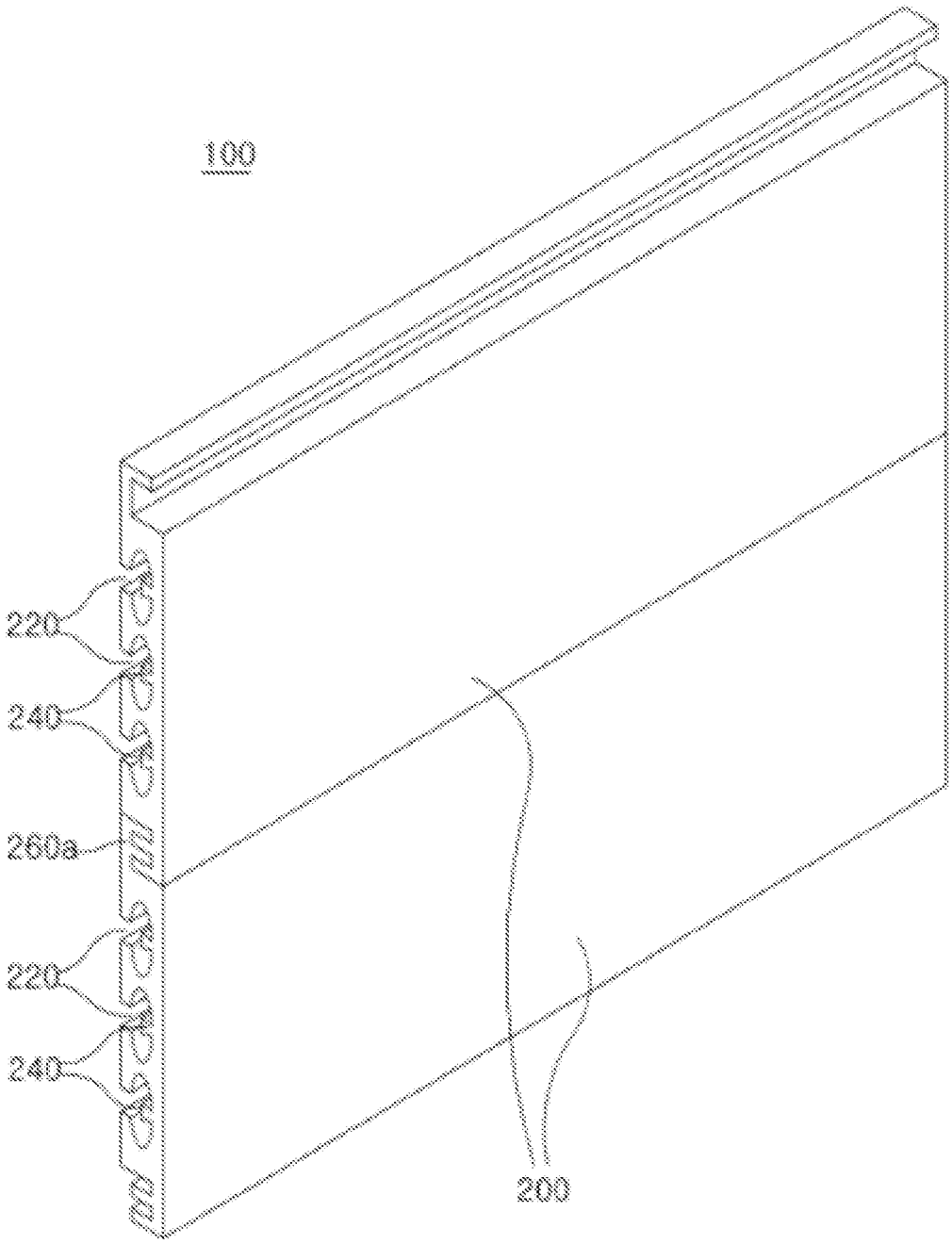
FIGS. 6 and 7 are perspective views showing the engaged state of the construction member according to the present invention shown in FIGS. 4 and 5.
Figure 7:
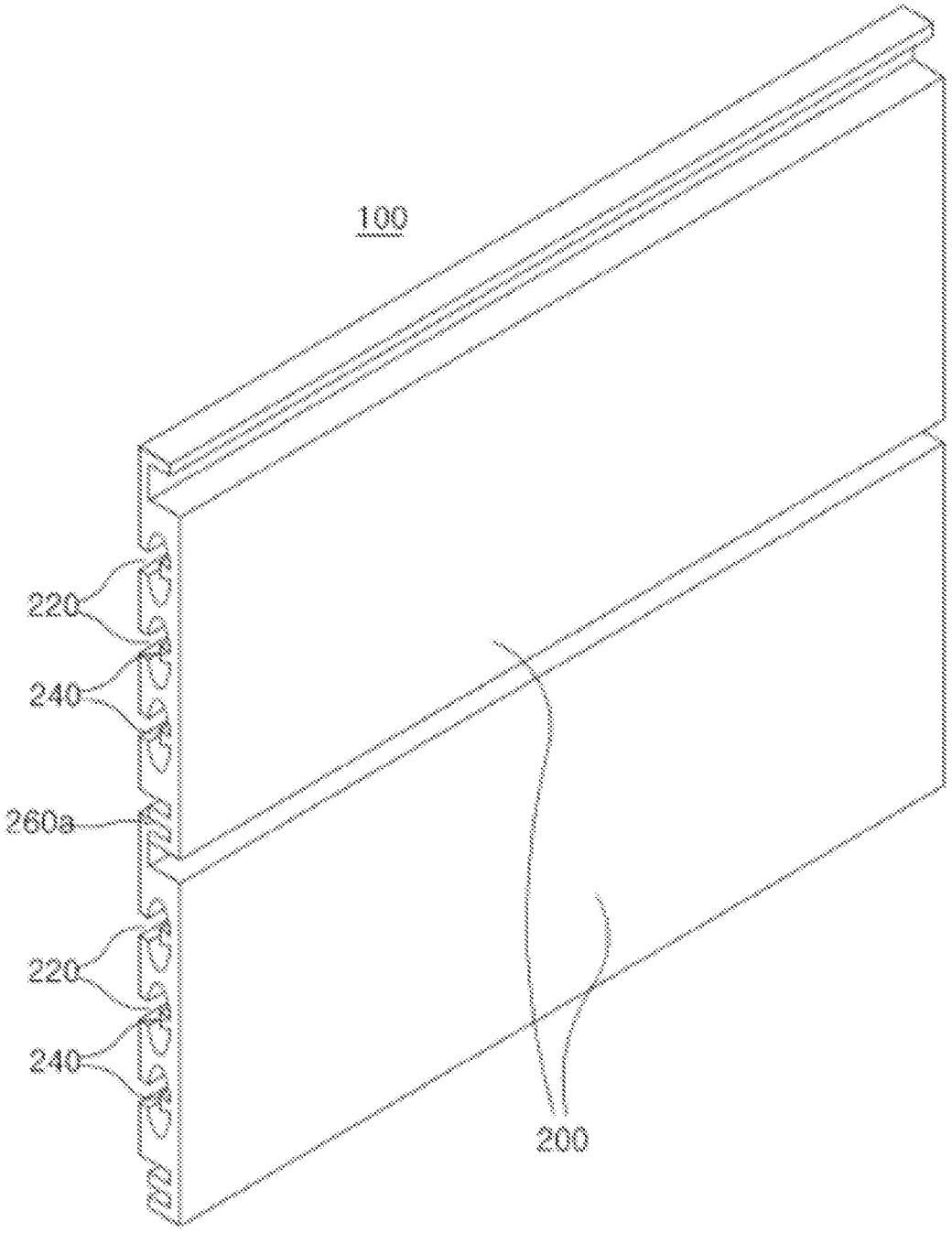

This will now be described with reference to the accompanying drawings. FIGS. 4 and 5 are views showing another embodiment of the member engagement portion positioned at the upper and lower portions of the construction member according to the present invention shown in FIG. 1, and FIGS. 6 and 7 are perspective views showing the engaged state of the construction member according to the present invention shown in FIGS. 4 and 5.

That is, it is possible to facilitate engagement of the member 200 with another member 200 and to increase support force by modifying the shape of the member engagement portion 260*a* formed at the upper and lower end portions of the member 200.

Further, the member engagement portion 260*a* includes a first engagement portion 261*a*, which includes a first engagement groove 262*a* and a first engagement protrusion 263*a* formed at the upper portion of the member 200 in the longitudinal direction of the member 200, and a second engagement portion 264*a*, which includes a second engagement protrusion 265*a* and a second engagement groove 266*a* formed at the lower portion of the member 200 in the longitudinal direction of the member 200 so as to be engaged with the first engagement groove and the first engagement protrusion of another member.

That is, the member 200 is capable of being continuously installed together with other members in the vertical direction using the first engagement portion 261*a* and the second engagement portion 264*a* formed at the upper and lower portions thereof in the longitudinal direction thereof. Further, the engagement structure is capable of enhancing engagement between the members and preventing permeation of rainwater.

In this case, the position of the first engagement portion 261*a* and the position of the second engagement portion 264*a*, which constitute the member engagement portion 260*a*, may be interchanged. Further, in order to naturally form a groove, the engagement position of the member 200 may be changed as shown in FIG. 7.

In addition, an auxiliary engagement portion 267*a*, which includes an auxiliary engagement groove 268*a* and an auxiliary engagement protrusion 269*a*, may be further formed in the first engagement groove 262*a* constituting the first engagement portion 261*a*.

That is, the member engagement portion 260*a* may selectively include the auxiliary engagement portion 267*a*, which is composed of at least one auxiliary engagement groove

268*a* and at least one auxiliary engagement protrusion 269*a* and is formed in the first engagement portion 261*a*, thereby enabling adjustment of the engagement position of the member 200.

Alternatively, the member 200 constituting the construction member 100 may be configured as shown in FIGS. 8 to 11.

Figure 8:
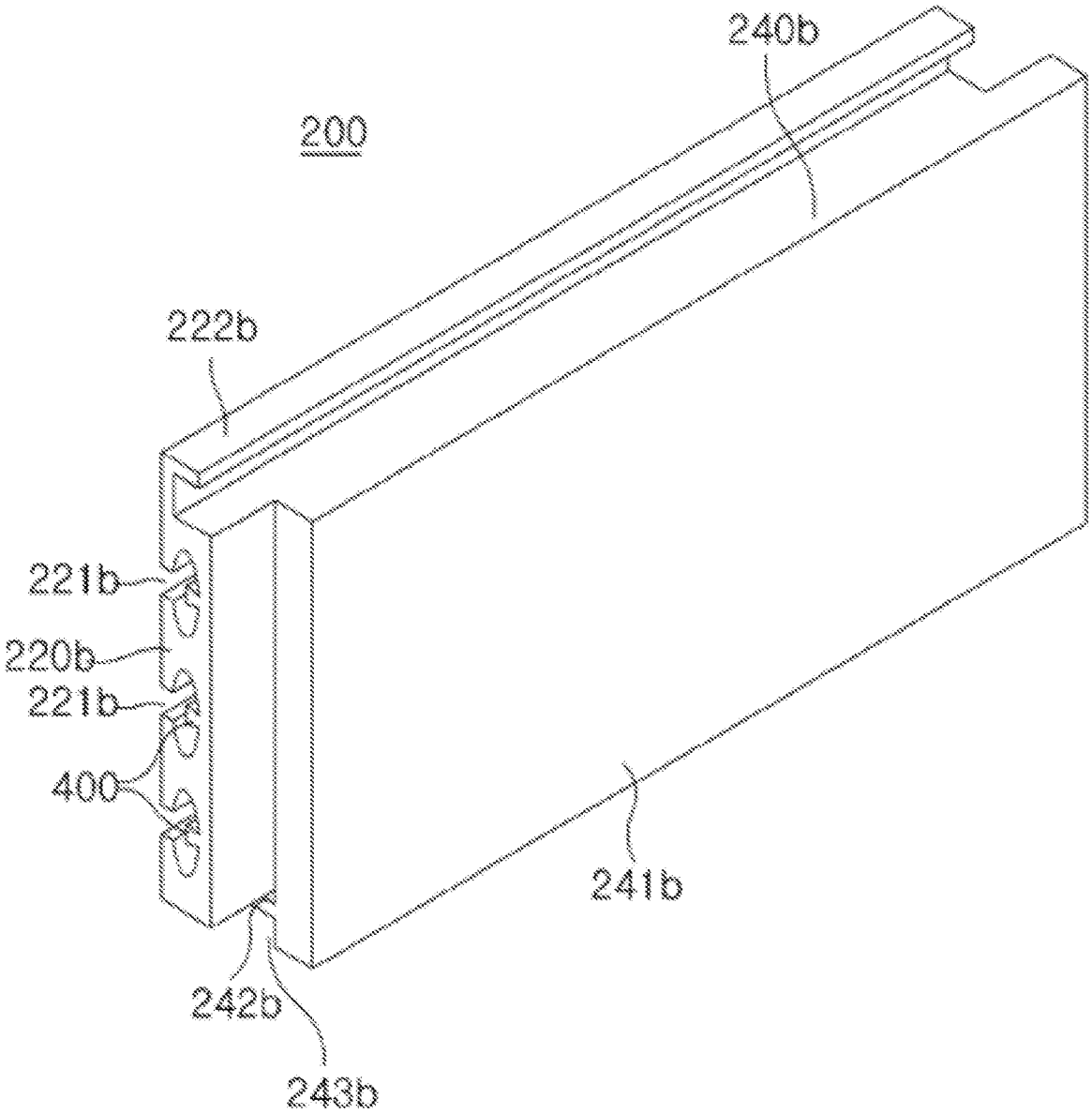
FIG. 8 is a perspective view showing another embodiment of the construction member according to the present invention.
Figure 9:
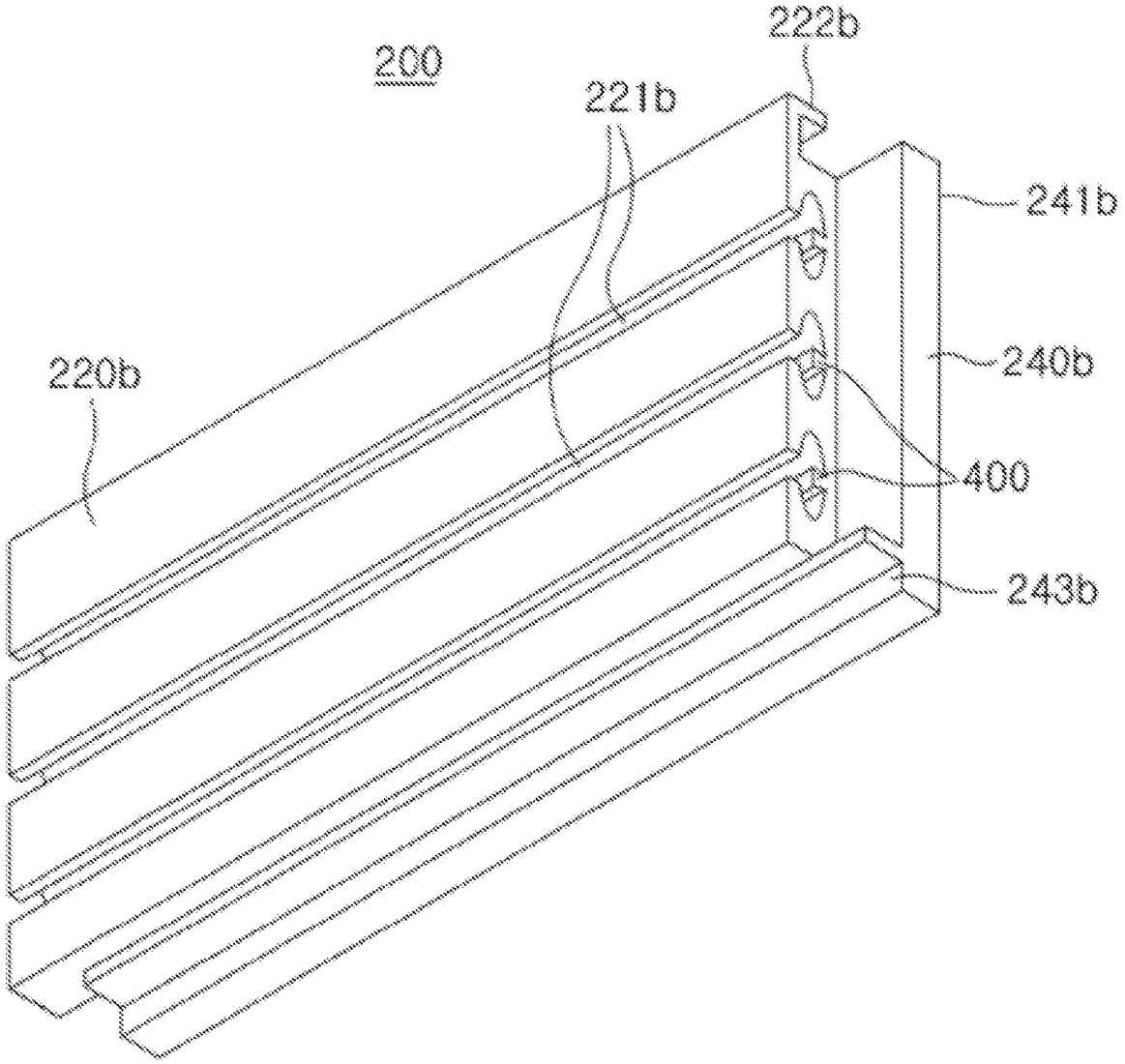
FIG. 9 is a rear perspective view of the construction member according to the present invention shown in FIG. 8.
Figure 10:
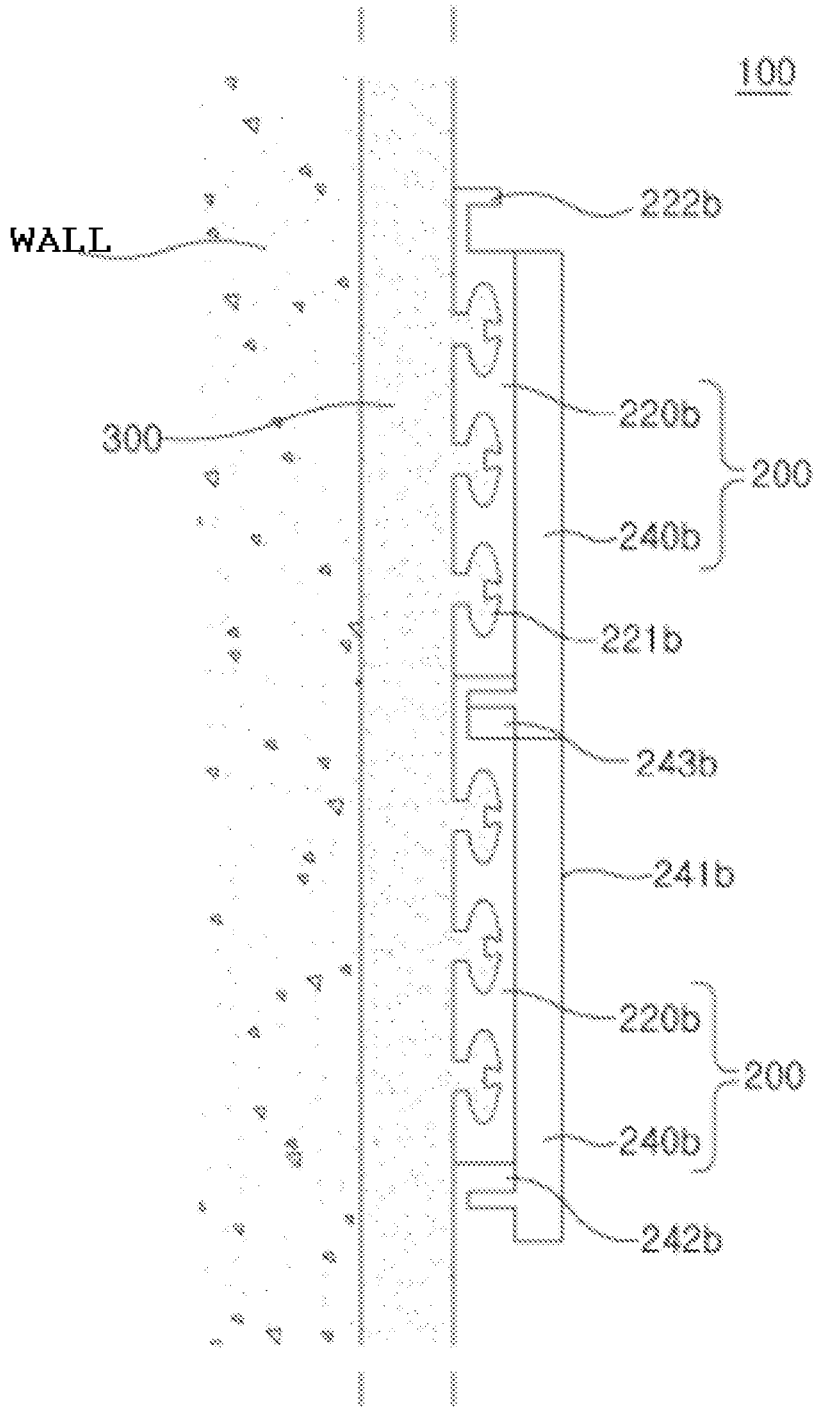
FIGS. 10 and 11 are cross-sectional views showing the installation state of the present invention shown in FIG. 8.
Figure 11:
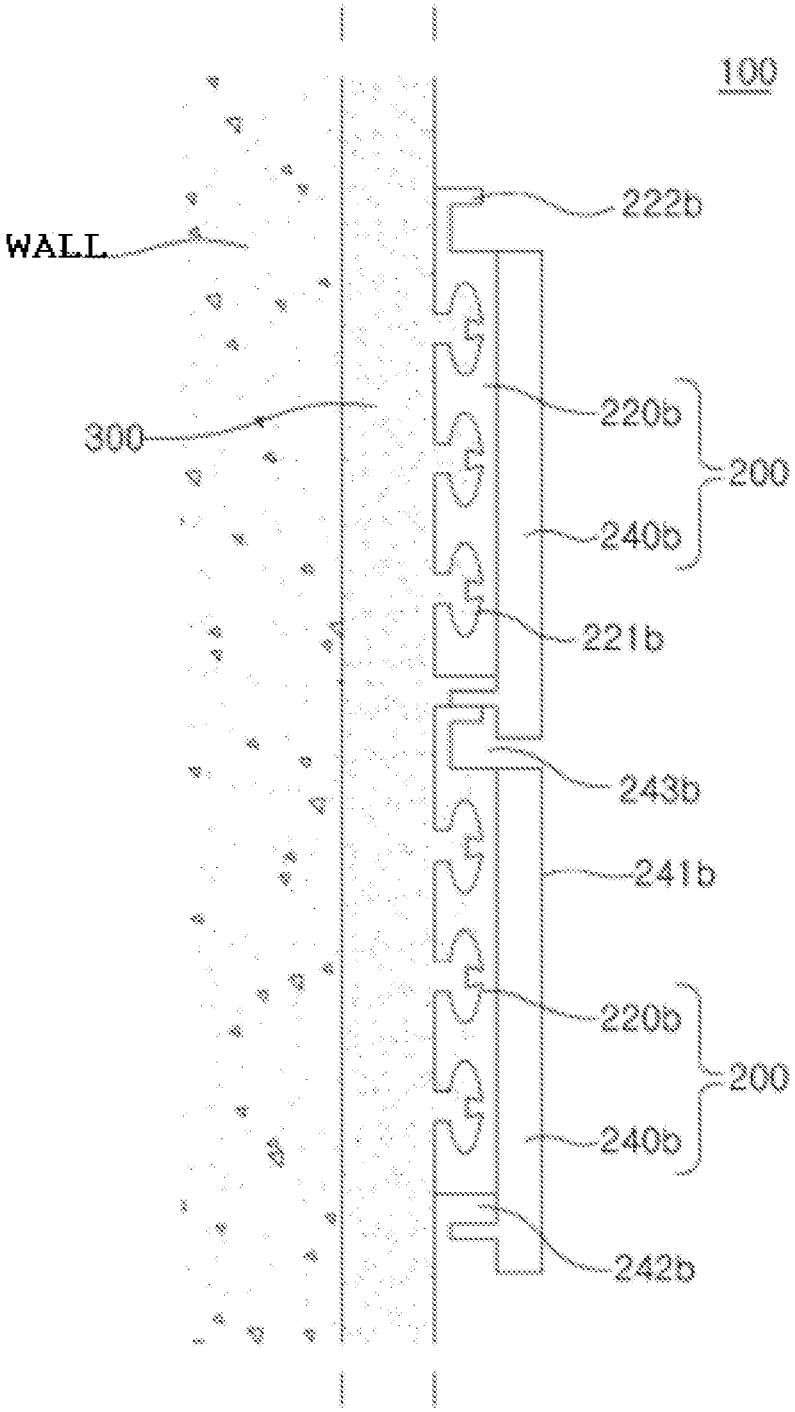

This will now be described with reference to the accompanying drawings. FIG. 8 is a perspective view showing another embodiment of the construction member according to the present invention, FIG. 9 is a rear perspective view of the construction member according to the present invention shown in FIG. 8, and FIGS. 10 and 11 are cross-sectional views showing the installation state of the present invention shown in FIG. 8.

The member 200 includes a rear surface portion 220*b*, which has a member insertion groove 221*b* formed therein and an engagement protrusion 222*b* formed at the upper end portion thereof in the longitudinal direction thereof, and a front surface portion 240*b*, which is integrally formed with the front portion of the rear surface portion 220*b*, has a front surface 241*b* extending vertically, and has an engagement groove 242*b* formed in the lower portion thereof so as to allow the engagement protrusion of another member to be inserted thereinto.

That is, due to the configuration thereof in which the rear surface portion 220*b*, having the member insertion groove 221*b* and the engagement protrusion 222*b*, and the front surface portion 240*b*, having the engagement groove 242*b*, are integrally formed with each other, the member 200 is capable of being continuously installed on walls of buildings in the upward/downward direction, in the leftward/rightward direction, or in all directions.

In this case, a space portion 243*b* may be selectively formed below the engagement groove 242*b* formed in the front surface portion 240*b* in order to secure smooth engagement and to induce natural formation of a groove.

In addition, as shown in FIGS. 12 to 15, the construction member 100 may be selectively equipped with binding members 500 in order to increase the strength of bonding of the member 200 to the adhesive material 300 or to walls of buildings.

Figure 12:
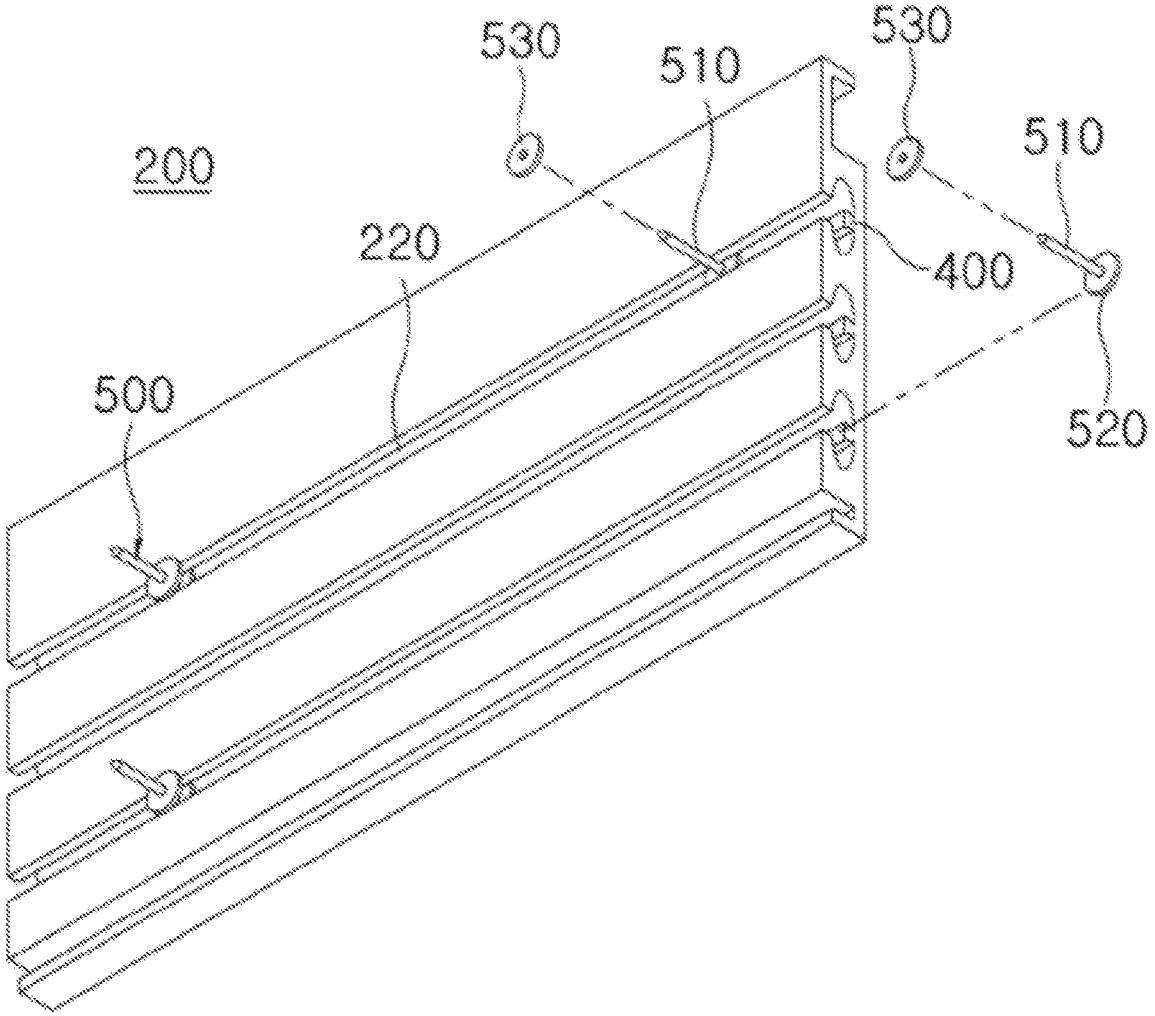
FIGS. 12 and 13 are views showing a binding member used to install the construction member according to the present invention.
Figure 13:
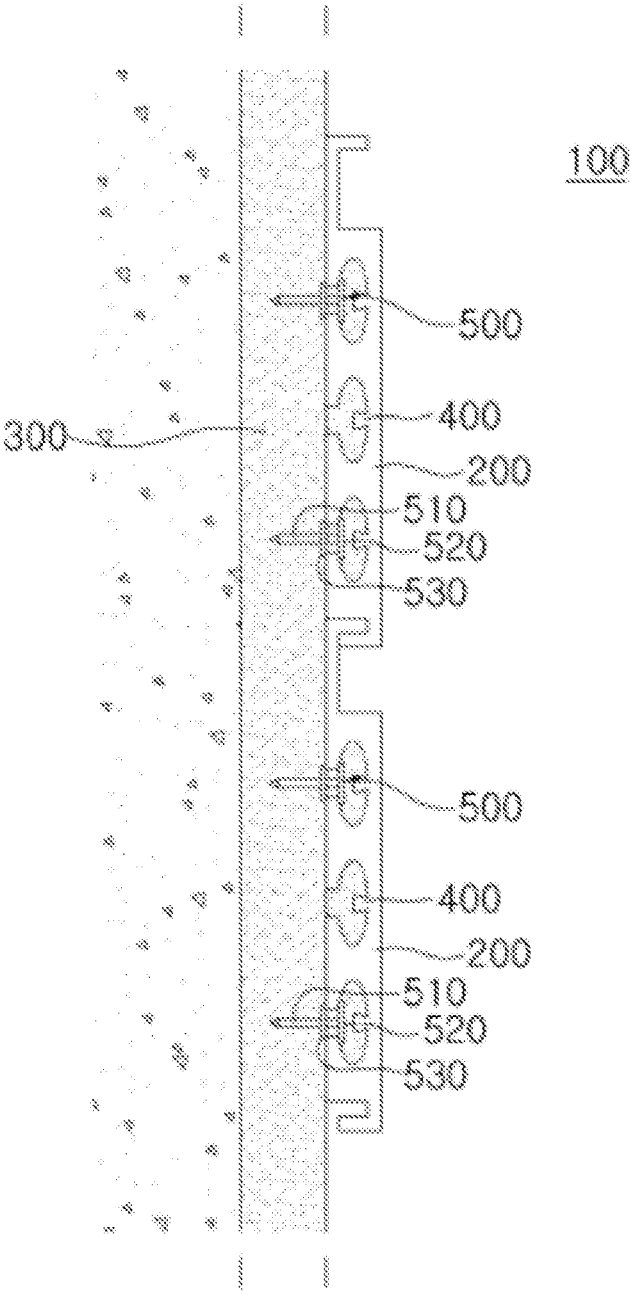

This will now be described with reference to the accompanying drawings. FIGS. 12 and 13 are views showing the binding members used to install the construction member according to the present invention.

The binding members 500 are mounted so as to be spaced apart from each other in the member insertion groove 220 in the member 200 in order to increase the strength of bonding of the member 200 to walls of buildings or to the adhesive material 300.

The binding member 500 includes a body 510, which has a sharp shape, a head portion 520, which is formed at the end of the body 510 and is slidably inserted into and supported by the member insertion groove 220, and a washer 530, which is fitted on the body 510 and is disposed outside the inlet 222.

That is, the binding member 500, having the body 510 and the head portion 520 integrally formed with each other, is mounted so as to be spaced apart from another binding member in the member insertion groove 220, and the washer 530 is fitted on and fixed to the body 510 outside the inlet 222. In this state, the binding member 500 is bonded to the adhesive material 300.

Figure 14:
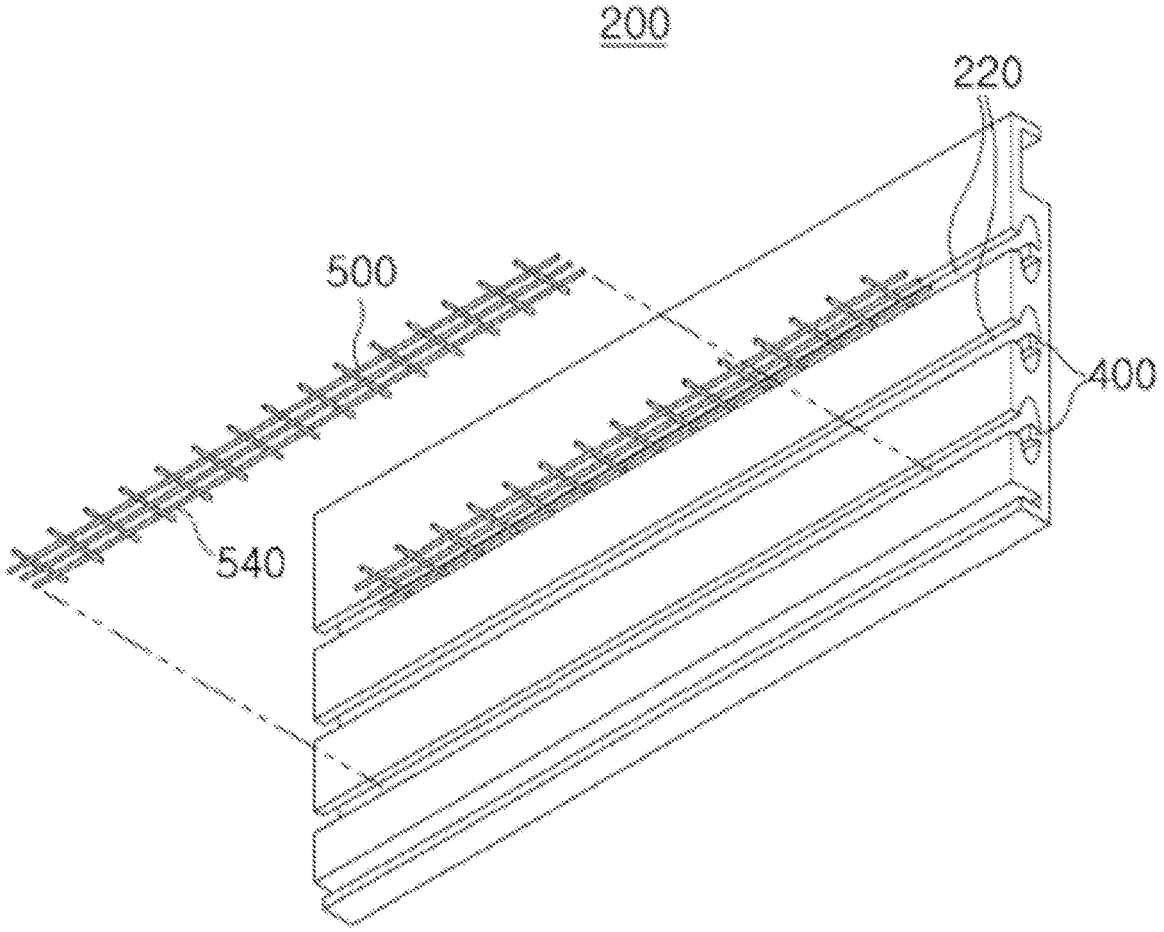
FIGS. 14 and 15 are views showing another embodiment of a binding member used to install the construction member according to the present invention.
Figure 15:
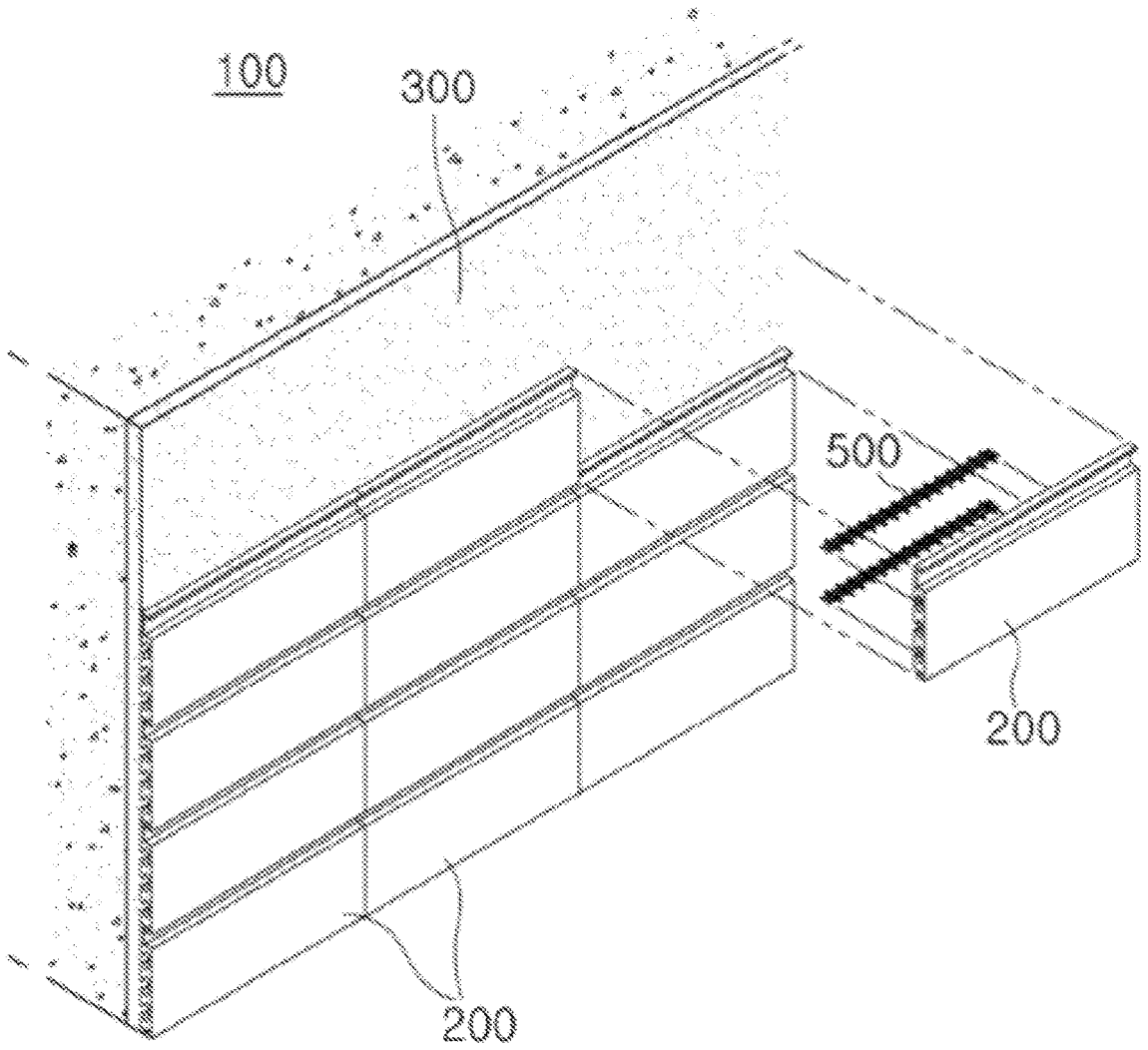

Alternatively, the binding member 500 may be configured as shown in FIGS. 14 and 15.

Specifically, the binding member 500 may be configured as a lattice-shaped wire net in order to increase the strength of bonding to the adhesive material 300.

In this case, an insertion portion 540, which is to be inserted into the member insertion groove 220, may be formed to be straight or curved in order to increase bonding force.

Figure 16:
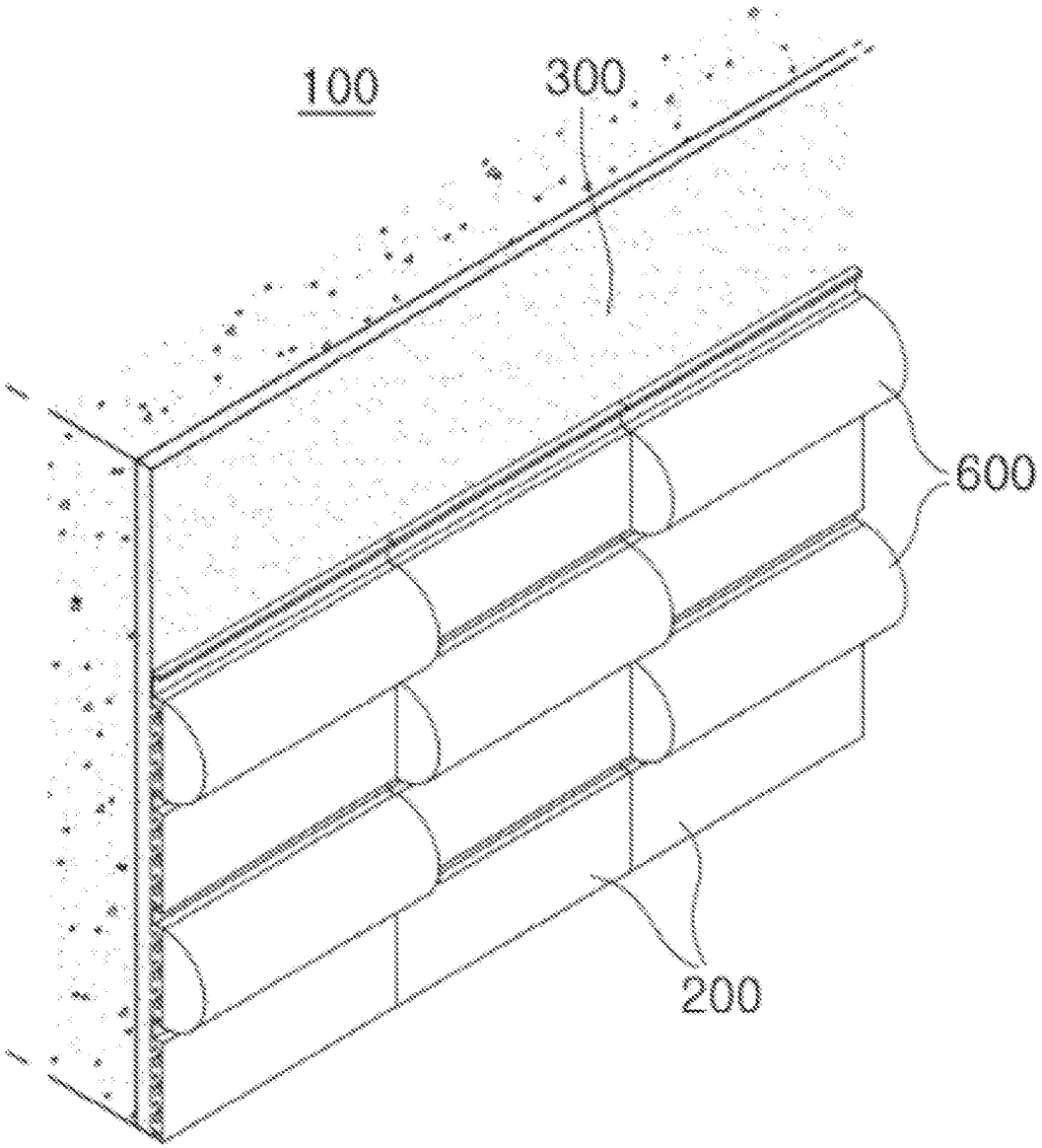
FIG. 16 is a view showing the state of use of an ornament member used to install the construction member according to the present invention.

In addition, as shown in FIG. 16, the construction member 100 may include an ornament member 600, which is selectively mounted on the front portion of the member 200.

Specifically, the ornament member 600 may be selectively mounted on the front portion of the member 200, thereby enhancing the aesthetic effect.

In this case, the shape of the ornament member 600 is not limited to what is shown in the drawings, and may be changed to any of various other shapes.

Figure 17:
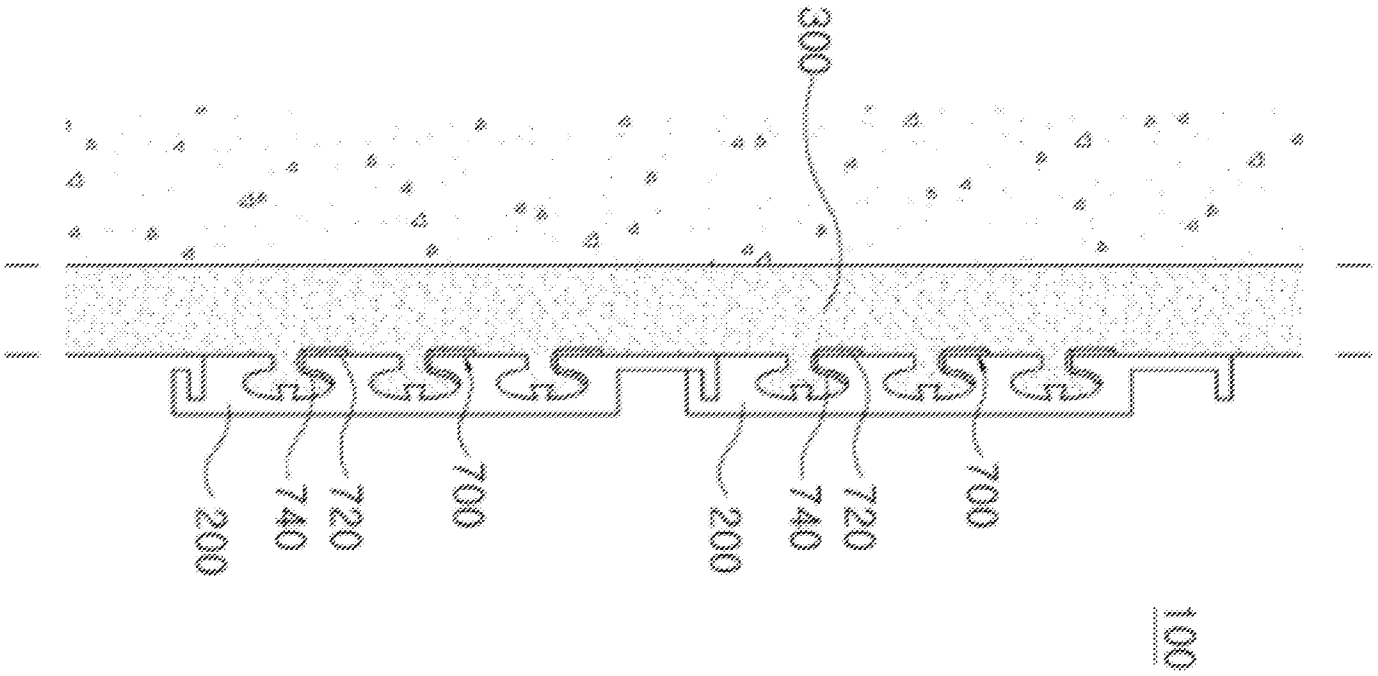
FIG. 17 is a cross-sectional view showing the state of use of a fixing support member used to install the construction member according to the present invention.

In addition, as shown in FIG. 17, the construction member 100 may include fixing support members 700, which are mounted so as to be spaced apart from each other in the member insertion groove 220 formed in the member 200.

Here, the fixing support member 700 includes one side 720, which is located outside the member insertion groove 220 and is fixed to the external adhesive material 300, and an opposite side 740, which supports the upper portion of the member insertion groove 220.

An embodiment of the construction member configured as described above will be described below.

First, a plurality of members 200, each of which is formed in a rectangular shape and has member insertion grooves 220 formed in the horizontal direction in the rear surface thereof so as to be spaced apart from each other in the vertical direction, is formed.

Subsequently, an adhesive material 300, such as cement or mortar, is inserted into the member insertion grooves 220 in the members 200, and the members 200 provided with the adhesive material 300 are continuously installed on a wall of a building.

Subsequently, when another member 200 is engaged with the upper portion of the member 200, it is possible to easily adjust the positions of the members 200 and to fix the same using the member engagement portions of the members 200.

Here, it is to be understood that the construction member may be assembled in an order different from that described above.

While the present invention has been particularly shown and described with reference to exemplary embodiments thereof, these embodiments are only proposed for illustrative purposes, and it will be apparent to those skilled in the art that various changes in form and details may be made without departing from the essential characteristics of the present invention.

Therefore, the exemplary embodiments should be considered in a descriptive sense only and not for purposes of limitation. The scope of the invention is defined not by the detailed description of the invention but by the appended claims, and encompasses all modifications and equivalents that fall within the scope of the appended claims.

<Description of Reference Numerals>

| | |
|---|---|
| 100: construction member | 200: member |
| 220: member insertion groove | 222: inlet |
| 224: member insertion space | 300: adhesive material |

INDUSTRIAL APPLICABILITY

The construction member according to the present invention includes members capable of being continuously installed on walls of buildings in the upward/downward direction, in the leftward/rightward direction, or in all directions. Each member is formed in a rectangular shape and has member insertion grooves formed in the horizontal direction in the rear surface thereof so as to be spaced apart from each other. Since at least one member insertion groove is formed in the rear surface of each member, it is possible to easily bond and fix the members to walls or floors of buildings, to reduce a construction period and costs, and to enable an unskilled worker to easily perform construction tasks.

The invention claimed is:

1. A construction member comprising:

members configured to be continuously installed on a wall of a building in an upward/downward direction, in a leftward/rightward direction, or in all directions, wherein each of the members is formed in a rectangular shape, and comprises member insertion grooves formed in a rear surface thereof in a longitudinal direction thereof so as to be spaced apart from each other in a vertical, horizontal, or oblique direction, wherein each of the member insertion grooves comprises an inlet communicating with an outside and a member insertion space extending inwards from the inlet and accommodating an adhesive material therein, wherein the member insertion space is formed to be larger than the inlet, and wherein a support protrusion is formed in the member insertion space constituting each of the member insertion grooves so as to extend in a longitudinal direction of the member insertion space or to extend intermittently.

2. A construction member comprising:

members configured to be continuously installed on a wall of a building in an upward/downward direction, in a leftward/rightward direction, or in all directions, wherein each of the members is formed in a rectangular shape, and comprises member insertion grooves formed in a rear surface thereof in a longitudinal direction thereof so as to be spaced apart from each other in a vertical, horizontal, or oblique direction, wherein binding members are selectively mounted so as to be spaced apart from each other in each of the member insertion grooves in a respective one of the members in order to increase strength of bonding to a wall of a building or to an adhesive material, and wherein each of the binding members comprises a body having a sharp shape, a head portion formed at an end of the body and slidably inserted into and supported by a corresponding one of the member insertion grooves, and a washer fitted on the body and disposed outside an inlet.

3. A construction member comprising:

members configured to be continuously installed on a wall of a building in an upward/downward direction, in a leftward/rightward direction, or in all directions, wherein each of the members is formed in a rectangular shape, and comprises member insertion grooves formed in a rear surface thereof in a longitudinal direction thereof so as to be spaced apart from each other in a vertical, horizontal, or oblique direction, wherein binding members are selectively mounted so as to be spaced apart from each other in each of the member insertion grooves in a respective one of the members in order to increase strength of bonding to a wall of a building or to an adhesive material, and wherein each of the binding members is configured as one of a lattice-shaped wire net, a lattice-shaped fiber net, and a lattice-shaped glass net, and comprises an insertion portion configured to be inserted into a corresponding one of the member insertion grooves, the insertion portion being formed to be straight or curved.

4. A construction member comprising:

members configured to be continuously installed on a wall of a building in an upward/downward direction, in a leftward/rightward direction, or in all directions, wherein each of the members is formed in a rectangular shape, and comprises member insertion grooves formed in a rear surface thereof in a longitudinal direction thereof so as to be spaced apart from each other in a vertical, horizontal, or oblique direction, and wherein a plurality of auxiliary bonding grooves or a plurality of auxiliary bonding protrusions is formed so as to be spaced apart from each other between the member insertion grooves.

* * * * *